United States Patent [19]

Kegley

[11] Patent Number: 4,985,961

[45] Date of Patent: Jan. 22, 1991

[54] HANDLE AND IMPLEMENT HEAD ASSEMBLY

[76] Inventor: Boyd F. Kegley, 8402 Catamaran Dr., Indianapolis, Ind. 46236

[21] Appl. No.: 426,098

[22] Filed: Oct. 24, 1989

[51] Int. Cl.[5] ..... B25G 1/00

[52] U.S. Cl. ..... 16/111 R; 16/110 R; 16/115; 294/57; 294/58; 56/400.17; 56/DIG. 18; 15/143 B; 15/159 R; D8/13; D8/107; 81/489

[58] Field of Search ..... 16/110 R, 111 R, 112, 16/114 R, 115; 294/57, 58; 56/400.01, 400.17, DIG. 18; 15/143 R, 144 B, 159 R; D8/13, 109; 81/489

[56] References Cited

U.S. PATENT DOCUMENTS

| | | | |
|---|---|---|---|
| 4,690,447 | 9/1987 | Adams | 294/58 |
| 4,704,758 | 11/1987 | Hoffman | 294/57 |
| 4,756,480 | 7/1988 | Fish | 16/114 R |

FOREIGN PATENT DOCUMENTS

| | | | |
|---|---|---|---|
| 81309 | 7/1963 | France | 294/57 |
| 1407731 | 6/1964 | France | 294/57 |
| 748446 | 5/1956 | United Kingdom | 294/57 |

*Primary Examiner*—Richard K. Seidel
*Assistant Examiner*—Edward A. Brown
*Attorney, Agent, or Firm*—Woodard, Emhardt, Naughton, Moriarty & McNett

[57] ABSTRACT

A handle and implement head assembly comprising an implement head having a working edge adjacent a substantially planar portion. The assembly further includes a pair of generally longitudinal gripping portions having parallel axes and a connection member that positions the pair of gripping portions on the same side of and substantially equidistant from a central plane which perpendicularly bisects the planar portion and passes through the center of the working edge. At least one of the gripping portions would be positioned outside the plane of the implement.

17 Claims, 4 Drawing Sheets

HANDLE AND IMPLEMENT HEAD ASSEMBLY

BACKGROUND OF THE INVENTION

This invention relates to handle constructions which may be used for rakes, brooms and the like.

Numerous handle constructions have been designed for use with rake heads, broom heads and similar implement heads. However, prior art handle constructions tended not to take advantage of conveniently positioning the gripping portions of the handle relative to the implement head and the user. By not advantageously adapting the handle construction to the human body for the task to be performed, many advantages such as reduced effort and stress on the user have not been realized in the past.

SUMMARY OF THE INVENTION

One embodiment of the present invention might involve a handle and implement head assembly which comprises an implement head having a working edge adjacent a substantially planar portion. The assembly would further include a pair of generally longitudinal gripping portions having parallel axes and a connection member for positioning the pair of gripping portions on the same side of and substantially equidistant from a central plane perpendicularly intersecting the center of the working edge. At least one of the gripping portions would be positioned outside an implement plane which is coplanar with the substantially planar portion.

One object of the invention is to provide an improved handle and implement assembly.

Still another object of the invention is to provide a handle and implement head assembly that reduces the user's physical stress and effort encountered during the task of using the implement.

A further object of the invention is to provide a handle and implement head assembly that reduces the amount of effort needed to use the implement, and thereby reduces the stress on the user's back, shoulders, arms, elbows, wrists, hands, and fingers involved.

Yet another object of the invention is to provide a handle and implement head assembly which has gripping members positioned relative to the implement head and user so as to allow the user's hands and body to assume an enhanced position and consequently impart force to the implement head during the user's normal forward stroke in a more efficient manner.

Other objects and benefits of the present invention can be discerned from the following written description and accompanying drawings.

DESCRIPTION OF THE PREFERRED EMBODIMENT

Figure 1:
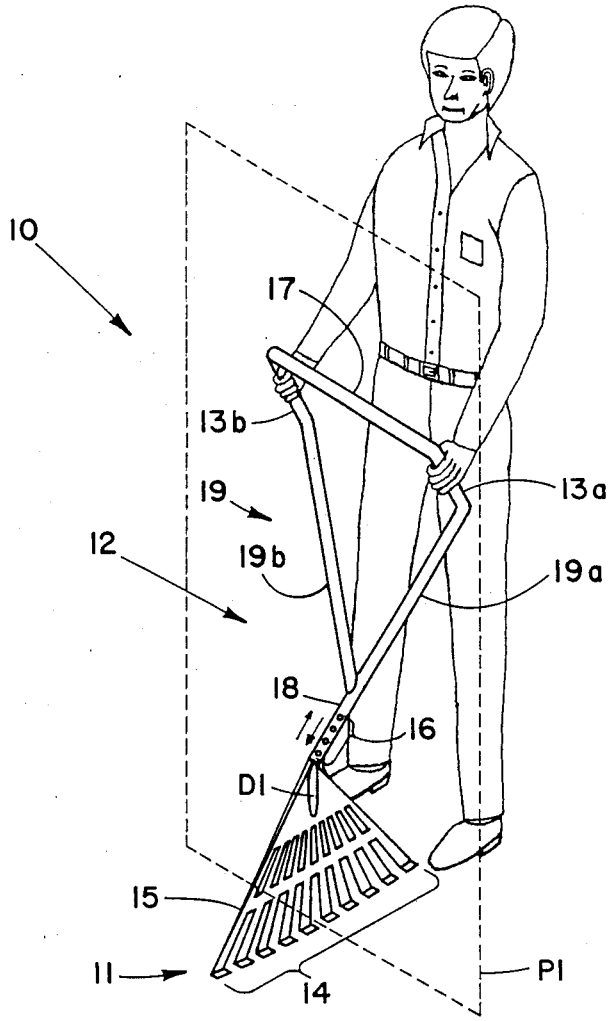
FIG. 1 is a perspective view of the handle and implement head assembly of the present invention in its unextended mode.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1, 2, 3 and 4 there is illustrated a handle and implement head assembly 10. The assembly 10 comprises in general an implement head 11, a connection member 12 and a pair of generally longitudinally shaped gripping portions 13. Gripping portions 13 include a first gripping portion **13*a* and a second gripping portion 13*b***.

It should be pointed out that while this invention depicts the use of the handle portion employed in conjunction with a rake, the handle unit may be used in combination with a variety of other implement heads such as brooms and the like.

Figure 5:
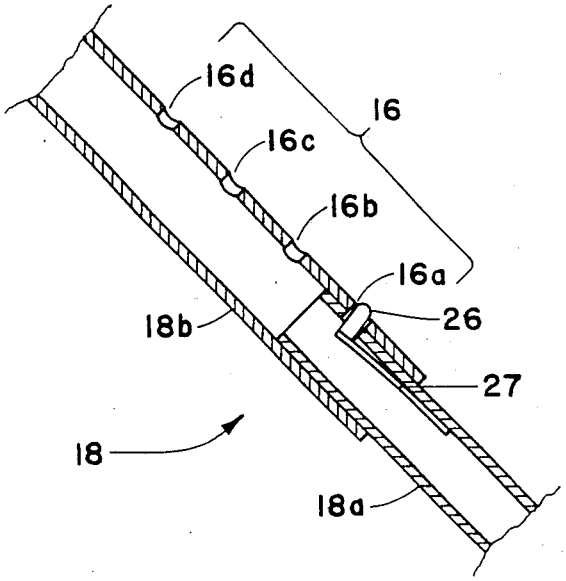
FIG. 5 is a cross sectional view of a portion of the lower connection portion of the handle and implement assembly of FIG. 1, in its extended mode, showing the detail of the extension latch mechanism.

Connection member 12 is positioned substantially upright and includes a lower connection portion 18 and upper connection portion 19. Upper connection portion 19 includes a first upper connection portion **19*a* and a second upper connection portion 19*b*. Lower connection portion 18 includes and is secured to implement head 11 by a readily adjustable securing means 16. Securing means 16 may be used with the invention to readily adjust the distance between the implement head 11 and gripping portions 13. Providing such a securing means allows the user to adjust the gripping portions to a vertical height with which the user would feel most comfortable. As illustrated in FIG. 5, securing means 16 used in the preferred embodiment includes a number of serially aligned apertures 16*a*–16*d* in an outer tubular member 18*b*, and a cooperating readily retractable protruding member 26 which is spring biased into position by leaf spring 27 fixed to the inside of inner tubular member 18*a*. By depressing the protruding member 26, the outer tubular member 18*b* can slide to an alternative position with respect to the inner tubular member 18*a*, and resiliently lock into place. Other suitable readily adjustable securing means are known in the art and may alternatively be used with the invention to readily adjust the distance between the implement head 11 and gripping portions 13. The tubular members 18*a* and 18*b*** may be keyed to prevent rotation.

At its upper ends, first and second upper connection portions **19*a* and 19*b* are attached to first and second gripping portions 13*a* and 13*b* respectively. The gripping portions are about 17 inches apart. Preferrably such gripping portions are from about 13 to about 21 inches apart. Such members are attached by being continuously cast together, however, other suitable attaching means such as screws, rivets or the like may be used. Gripping portions 13*a* and 13*b* may be maintained at a distance apart of about 40% of the distance from a working edge 14 to gripping portion 13*a*. A cross member 17 is fixedly positioned between gripping members 13*a* and 13*b*. Cross member 17 is attached to gripping portions 13 by being continuously cast together, however, other suitable attaching means such as those earlier mentioned may be used. Cross member 17 provides stability to first and second upper connection portions 19***a* and 19*b* as well as enhancing safety by avoiding protruding gripping member ends.

At its lower ends, first and second upper connection portions 19*a* and 19*b* are attached to lower connection portion 18. All three members are preferrably made of a continuous tubular material beginning at portion 18*b*, and continuing through portion 19*a*, gripping portion 13*a*, cross member 17, gripping portion 13*b*, and portion 19*b*, where it terminates at the junction of portion 18*b* and 19*a*.

Figure 2:
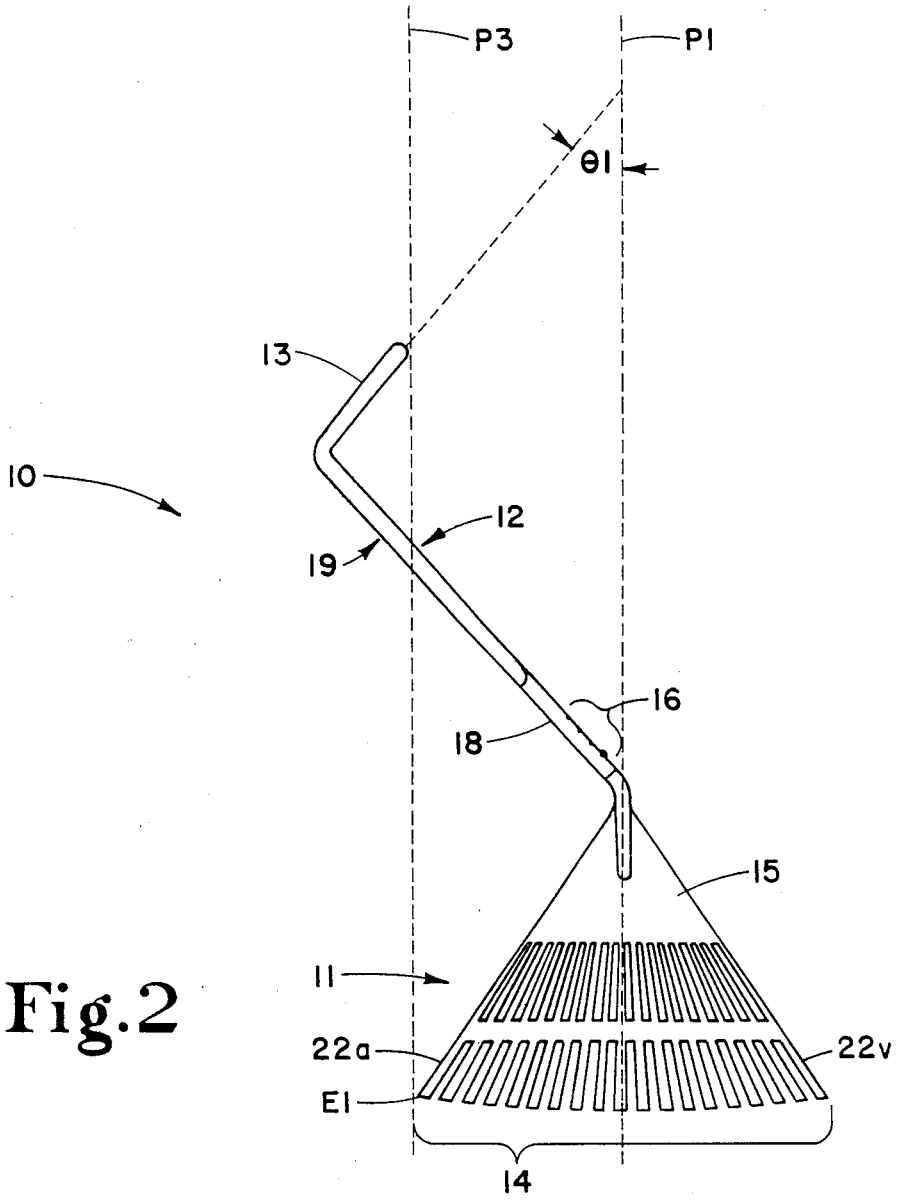
FIG. 2 is a front elevational view of the handle and implement assembly of FIG. 1.
Figure 4:
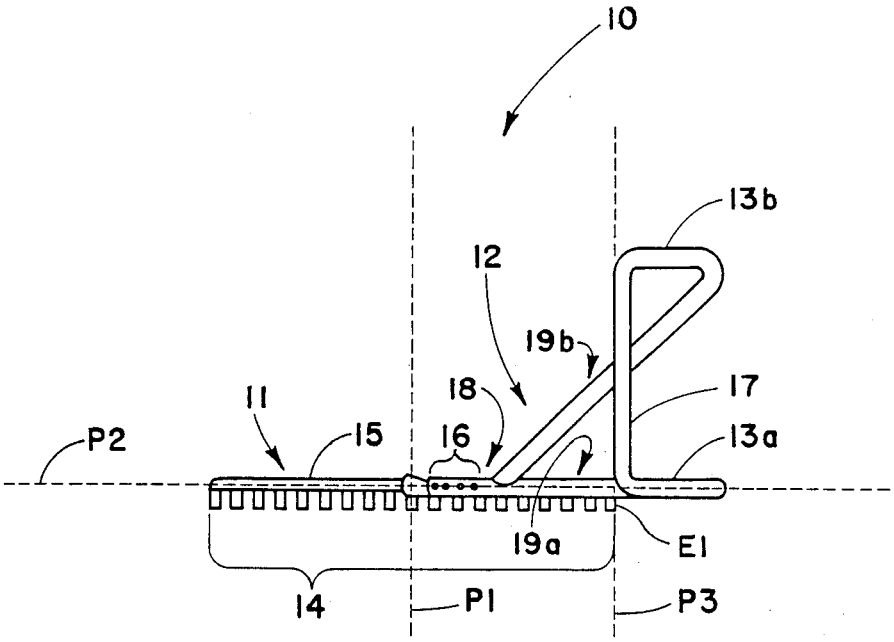
FIG. 4 is a top elevational view of the handle and implement assembly of FIG. 1.

Implement head 11 is a rake head which includes 22 flexible tines 22*a*–22*v* (fewer are shown in the drawings for clarity of illustration), which terminate at a working edge 14. The rake head is of a type conventionally used for raking leaves, although alternatively one can use an increased size rake head in view of the increased effectiveness of the invention. Working edge 14 is adjacent to the substantially planar portion 15 of the implement head. A central plane P1 perpendicularly intersects the center of working edge 14 as shown in FIGS. 1,2 and 4. Central plane P1 bisects substantially planar portion 15 at dotted line D1 (see FIG. 1). Connection member 12 and gripping portions 13 are completely positioned on the same side of central plane P1. In addition, first and second gripping portions 13*a* and 13*b* respectively are positioned substantially the same distance away from central plane P1. By positioning each of the gripping portions 13*a* and 13*b* on the same side of and substantially equidistant from center plane P1, the user is able to assume a more comfortable bodily position during the act of using the hand implement. Other ergonomic advantages of the above feature will be discussed below.

Figure 3:
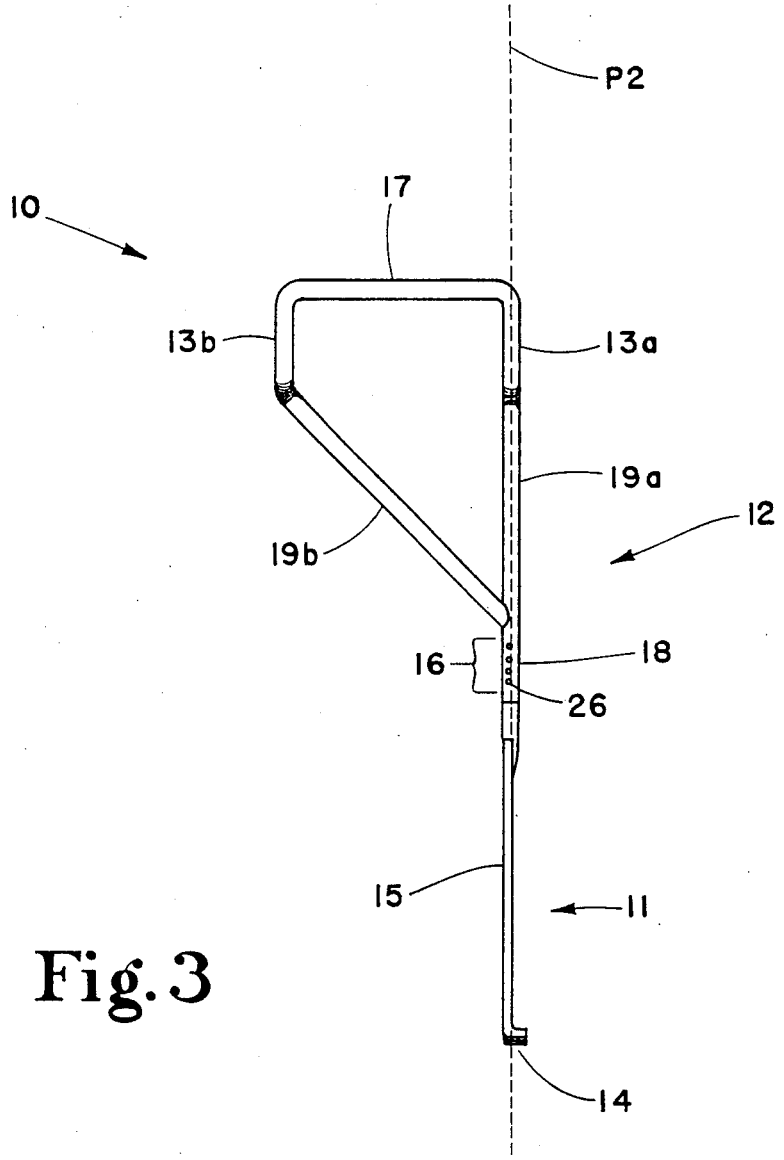
FIG. 3 is a side elevational view of the handle and implement assembly of FIG. 1.

An implement plane P2 is coplanar with substantially planar portion 15 as indicated in FIGS. 3 and 4. First gripping portion 13*a* is positioned in implement plane P2 while second gripping portion 13*b* is positioned outside implement plane P2. By positioning at least one of the gripping members outside implement plane P2, the user is able to apply a significant torque to implement head 11 which greatly aids in the manipulation of the implement head during use of the hand implement.

In FIGS. 2 and 4, it can be seen that an end plane P3 is parallel to central plane P1 and intersects one of the ends of working edge 14 at location E1. Gripping portions 13 are positioned, when compared to working edge 14, on the opposite side of end plane P3. With gripping portions 13 positioned at the above convenient location, the user can comfortably reach the gripping portions during the act of using the hand implement. Further ergonomic advantage of the above feature will be discussed below.

As illustrated in FIG. 2, gripping portions 13 are positioned such that each of the angles R1, defined by each of the gripping portions 13 relative to central plane P1, is about 45°. By positioning the gripping at an angle comfortable to the user, significant ergonomic advantages (discussed below) may be achieved. Preferrably angles R1 are from 20° to 60°, and more preferrably are from 35° to 50°.

By positioning of gripping members 13*a* and 13*b* at the location and orientation described in the foregoing paragraphs, the handle and implement head assembly 10 can be advantageously adapted to the human body for the task to be performed. There exist significant ergonomic advantages associated with positioning gripping portions 13*a* and 13*b* in the most preferred fashion at (1) a comfortable vertical height relative to the user's body height, (2) a comfortable distance apart relative to the user's body width, (3) equal distances from the center plane, (4) the opposite side of the end plane relative to the working edge, and (5) an angle defined by the gripping portions relative to the central plane that is about 45°. For instance, one of the aforementioned advantages is that the human effort which is required to propel the implement head against the countervailing forces of stationary leaves or the like can be low while the speed of motion of the implement head is high. In other words, such arrangement of the gripping members relative to the implement head and user would allow the user's hands and body to assume an enhanced position and consequently impart force to the rake head during the forward stroke in a more efficient manner. Another advantage would be that such positioning of the gripping members would significantly reduce the stress on the user's back, shoulders, arms, elbows, wrists, hands, and fingers during the task of raking or the like since the gripping members are positioned conveniently in front of the user and at an angle comfortable to the user and therefore stress on the user's body is substantially reduced. On the contrary, a conventional implement such as a rake requires the user to grasp the implement at two relatively inconvenient positions with regard to location and angle thus resulting in undesirable stress on the user's back, shoulders, arms, elbows, wrists, hands, and fingers.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

It is possible to make the handles symmetrical about the implement plane. With symmetry about the implement plane, reversability for right handed and left handed alternatives can be readily achieved by adding a feature of pivoting of the implement head within the implement plane, with sufficient pivoting to place the handles equally distant from but on the opposite side of the central plane. Tines on the rake head which alternatively are bent in opposite directions or which are split to extend simultaneously in two directions may be used to facilitate change between right hand and left hand usage. One could modify the device shown by replacing the gripping member with bicycle handlebars, and using a single or double shaft to connect to the implement head. One could modify the device shown by eliminating the adjustment to the length to reduce cost and complexity. Alternatively, adjustability as to the spacing between the gripping portions could be added. The term "working edge" as used herein, in intended to refer to that portion which in normal use contacts the surface which is being worked by the implement.

What I claim is:

1. A handle and implement head assembly comprising:

an implement head having a working edge adjacent a substantially planar portion;

a pair of generally longitudinal gripping portions having axes parallel to each other;

a connection member positioning said pair of gripping portions a fixed distance apart on the same side of and substantially equidistant from a central plane perpendicularly bisecting said planar portion and passing through the center of the working edge, with at least one of said gripping portions being completely outside all implement planes which are coplanar with said substantially planar portion.

2. The handle and implement head assembly of claim 1 in which said connection member is configured to position at least some part of said pair of gripping portions, when compared to the working edge, on the opposite side of an end plane which is parallel to said central plane and intersects an end of said working edge.

3. The handle and implement head assembly of claim 1 in which the connection member has means for readily adjusting the distance between the implement head and said pair of gripping portions.

4. The handle and implement head assembly of claim 1 wherein the axes of said gripping portions are each oriented at an angle between about 20° and 60° relative to the central plane.

5. The handle and implement head assembly of claim 4 wherein each of said angles is about 45°.

6. The handle and implement head assembly of claim 5 wherein said connection member has an upper portion which has first and second upper connection portions and includes a lower connection portion.

7. A handle and implement head assembly comprising:

an implement head having a working edge adjacent a substantially planar portion;

a pair of generally longitudinal gripping portions having axes parallel to each other;

a connection member positioning said pair of gripping portions a fixed distance apart on the same side of and substantially equidistant from a central plane perpendicularly intersecting the center of the working edge, with at least one of said gripping portions being outside an implement plane which is coplanar with said substantially planar portion;

wherein the axes of said gripping portions are each oriented at an angle between about 20° and 60° relative to the central plane wherein said connection member has an upper portion which has first and second upper connection portions and includes a lower connection portion; and wherein said first upper connection portion is attached to one of said pair of gripping portions at a first end thereof and said second upper connection portion is attached to the other of said pair of gripping portions at a first end thereof.

8. The handle and implement head assembly of claim 7 which additionally includes a cross member attaching between the second ends of each of said pair of gripping portions.

9. The handle and implement head assembly of claim 8 in which said upper portion of said connection member, said pair of gripping portions, and said cross member are configured as a continuous tubular member.

10. The handle and implement head assembly of claim 1, 2, 3, 4, 5, 7, 8 or 9 wherein said implement head is selected from the group consisting of a rake head and a broom head.

11. The handle and implement head assembly of claim 10 in which said implement head is a rake having more than 12 flexible tines.

12. A handle and implement head assembly comprising:

an implement head having a working edge adjacent a substantially planar portion;

a pair of generally longitudinal gripping portions having axes which are noncollinear with each other;

a connection member positioning said pair of gripping portions on the same side of a central plane perpendicularly bisecting said planar portion and passing through the center of the working edge, with at least one of said gripping portions being, when compared to said implement head substantially on the opposite side of an edge plane which is parallel to the central plane and intersects an end of said working edge of said implement head, and in a postion so that the axes of said gripping portions are each oriented at an angle between 20° and 60° relative to the central plane.

13. The handle and implement head assembly of claim 12 in which said connection member is configured to position at least one of said pair of gripping portions outside of an implement plane coincident with the substantially planar portion of said implement head.

14. The handle and implement head assembly of claim 12 or 13 in which said implement head is a rake head having more than 12 flexible tines and said connection member is configured to position the axes of said gripping portions relative to the central plane between about 35° and 50°.

15. A handle and implement head assembly comprising:

an implement head having a working edge adjacent a substantially planar portion;

a pair of generally longitudinal gripping portions having axes which are noncollinear with each other;

a connection member positioning said pair of gripping portions so that substantially the entire portion of each of them is on the same side of a central plane perpendicularly bisecting said planar portion and passing through the center of the working edge, with each of said gripping portions having a first end closer to the central plane than its corresponding second end, and with each of said first ends being further than its corresponding second ends from an edge line perpendicular to said central plane at its intersection with the center of the working edge.

16. The handle and implement head assembly of claim 15 in which said pair of generally longitudinal gripping portions are about parallel to one another in orientation.

17. The handle and implement head assembly of claim 15 or 16 in which said implement head is a rake having more than 12 flexible tines.

* * * * *